US005312230A

United States Patent [19]

Oda et al.

[11] Patent Number: 5,312,230

[45] Date of Patent: May 17, 1994

[54] FAN DEVICE CAPABLE OF REDUCING THE STAGNANT FLOW AT THE ROOT AREA OF FAN BLADES

[75] Inventors: Siniti Oda, Okazaki; Shuji Komoda, Chiryu; Yoshihiko Sonoda, Kariya, all of Japan

[73] Assignee: Nippondenso Co., Ltd., Kariya, Japan

[21] Appl. No.: 991,190

[22] Filed: Dec. 16, 1992

[30] Foreign Application Priority Data

Dec. 20, 1991 [JP] Japan ..... 3-338667

[51] Int. Cl.[5] ..... F04D 29/38

[52] U.S. Cl. ..... 416/234; 416/169 A; 416/223 R; 416/243; 416/241 A; 415/119

[58] Field of Search ..... 416/223 R, 234, 238, 416/240, 243, 169 A, 241 A; 415/119

[56] References Cited

U.S. PATENT DOCUMENTS 3,173,490 3/1965 Stuart, III ..... 416/223 R
4,046,489 9/1977 Fairchild et al. ..... 416/169 A
4,063,852 12/1977 O'Connor .
4,568,242 2/1986 Susa et al. .
4,671,739 6/1987 Read et al. ..... 416/241 A
4,840,541 6/1989 Sakane et al. ..... 416/223 R
5,066,196 11/1991 Morofushi ..... 416/241 A

FOREIGN PATENT DOCUMENTS 63-13040 3/1988 Japan .

*Primary Examiner*—Edward K. Look
*Assistant Examiner*—Christopher Verdier
*Attorney, Agent, or Firm*—Cushman, Darby & Cushman

[57] ABSTRACT

An axial flow fan device capable of reducing the stagnant flow at the root area of blades. These blades 18 are arranged so that they extend radially from a boss portion 14 so that they are circumferentially spaced along the circumference of the boss portion 14. Each of the blades 18 has an arc shaped cross section having a bending ratio value $\alpha$, that is a ratio of the bending height h of the arc shape to the length l of the chord of the arc shape. The value of the bending ratio rapidly increases from the middle portion of the blade to the root portion. The value of the bending ratio at the root portion is about 12%.

9 Claims, 7 Drawing Sheets

FAN DEVICE CAPABLE OF REDUCING THE STAGNANT FLOW AT THE ROOT AREA OF FAN BLADES

BACKGROUND OF THE INVENTION

1. Field of the Invention

The present invention relates to an axial air flow fan suitably used for a water cooling system for a water cooled internal combustion engine.

2. Description of Related Art

High grade automobiles are now much in demand. Such vehicles usually employ an internal combustion engine having a larger cylinder volume and high output power, and in this case, a quality cooling system having an increased cooling ability is required. Therefore, the engine must have a cooling fan capable of increased performance. In order to obtain increased cooling performance, a high rotational fan speed is used and the fan must be operated for a longer time, which reduces fuel consumption efficiency of the engine and increases engine noise. In contrast to this, a reduction in a fuel consumption is required of many National or Regional governments such as CAFE and a demand for reduced noise is also required from the viewpoint of the environment. Thus, there is a strong demand to provide a fan with an improved construction capable of reducing noise without reducing the cooling performance.

Japanese Examined Patent Publication No 63-13040 discloses a cooling fan housed in a shroud and provided with a blade having an end portion defining a plane having an increased pitch (mounting) angle with respect to that of the remaining portion of the blade, which is effective for decreasing the strength of a vortex of air generated at the blade end that faces the inner surface of the shroud, with a short distance therebetween. Such a reduction in the strength of the vortex is aimed at reducing the operational noise as well as increasing the cooling efficiency.

However, the inventor's test reveals that, in addition to a vortex at the blade end, a stagnant area having a very low speed is created at the root location of a blade, which also reduces the performance of the fan.

SUMMARY OF THE INVENTION

An object of the present invention is to provide a fan with an improved construction capable of increasing efficiency and reducing operational noise.

According to the present invention, a fan device is provided and adapted to be connected to a rotating movement source for imparting a rotational movement to the fan device, comprising:

a boss having an axis for rotation and a circumferential wall about said first axis; the boss being connected to the rotating movement source for rotating the fan about the axis, and;

a plurality of radially extending, circumferentially spaced blades connected to said circumferential wall of said boss; each blade having a root portion connected to the boss and a free end portion; said blade forming an arc shaped cross section transverse to the radial extension thereof, as a desired ratio of the height of the arc to the length of the chord of the arc;

the blade being divided along the radial extension, a first area away from the boss and a second area near the boss; the arc shape of the cross section being such that the value of said bending ratio at the first region increases from the free end portion at a substantially constant rate, and at the second region increases toward the root portion at a rate that increases as it is located near said root portion.

BRIEF EXPLANATION OF ATTACHED DRAWINGS

DESCRIPTION OF A PREFERRED EMBODIMENT

Figure 1:
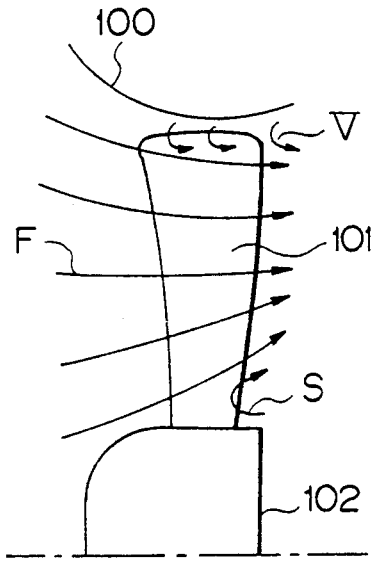
Fig. 1 (PRIOR ART)
FIG. 1 is a schematic side view of a fan device illustrating a problem encountered in the prior art.

A problem to be solved by the present invention will now be described with reference to FIG. 1, wherein air flows F are created in a shroud 100 by means of a rotation of a fan therein. At an area where the blade 101 of the fan faces the shroud 100, the air flows create a vortex V. The Japanese Examined Patent Publication No. 63-13040 is designed to reduce the occurrence of such a vortex at the outer end of a blade. In addition to such a vortex, the inventor has found that the air flow creates a stagnant area S at a root location where the blade 101 is connected to a hub portion 102 of the fan. Such a vortex V and stagnation area S causes the direction of the main flows F of the air to vary more than originally designed, which reduces efficiency. As a result, the prior art construction is disadvantageous in that the total area of the blade is not effectively used. Namely, the generation of the stagnant area reduces the efficiency and increases operational noise.

Figure 2:
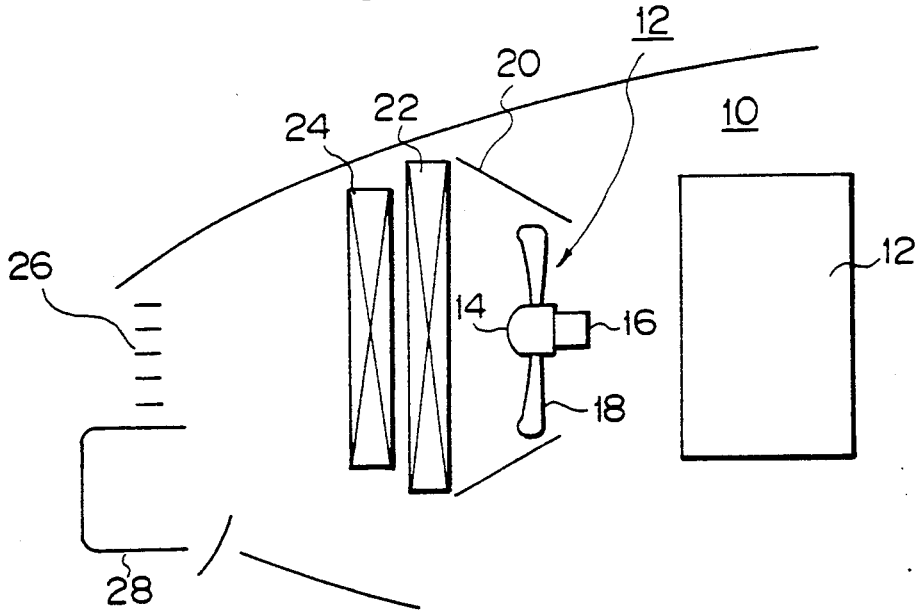
FIG. 2 shows an arrangement of a fan device according to the present invention in an engine room for an automobile.

A construction of the present invention that can overcome the above mentioned difficulty in the prior art will now be explained with reference to an embodiment. FIG. 2 shows, schematically, an engine room 10 of an automobile, in which a body 12 of an internal combustion engine is arranged. Arranged in front of the engine body 12 is a fan assembly 12 having a boss portion 14 connected to an electric motor 16 for imparting a rotational movement to the boss portion 14. The body of the motor 16 is fixedly connected to the engine room 10 by means of suitable members (not shown). A plurality of circumferentially spaced blades 18, each extending radially, are fixedly connected to the boss portion 14. The blades 18 together with the boss 14 are formed from a plastic resin material. The fan assembly 12 is housed in a shroud 20 having a substantially tubular shape and having the rear end opened to the engine body 12 and the front end opened to a radiator 22 having passageways (not shown) for an engine cooling liquid received from a water jacket (not shown) in the engine body 12 and returned to the water jacket. The fan shroud 20 is for effectively guiding an air flow created by the rotational movement of the fan assembly 12 through the radiator 22. When the vehicle is provided with an air conditioning apparatus for a cabin (not shown), a condenser 24 is arranged in front of the radiator 22, which is, as is well known, located in a recirculation passageway for a refrigerant for cooling the air and for air conditioning the cabin (not shown) of the vehicle. The vehicle has a front grille 26 at its front portion facing the condenser 24 for introduction of the outside air into the engine room 10. A reference numeral 28 denotes a bumper located below the front grille 26.

Figure 3:
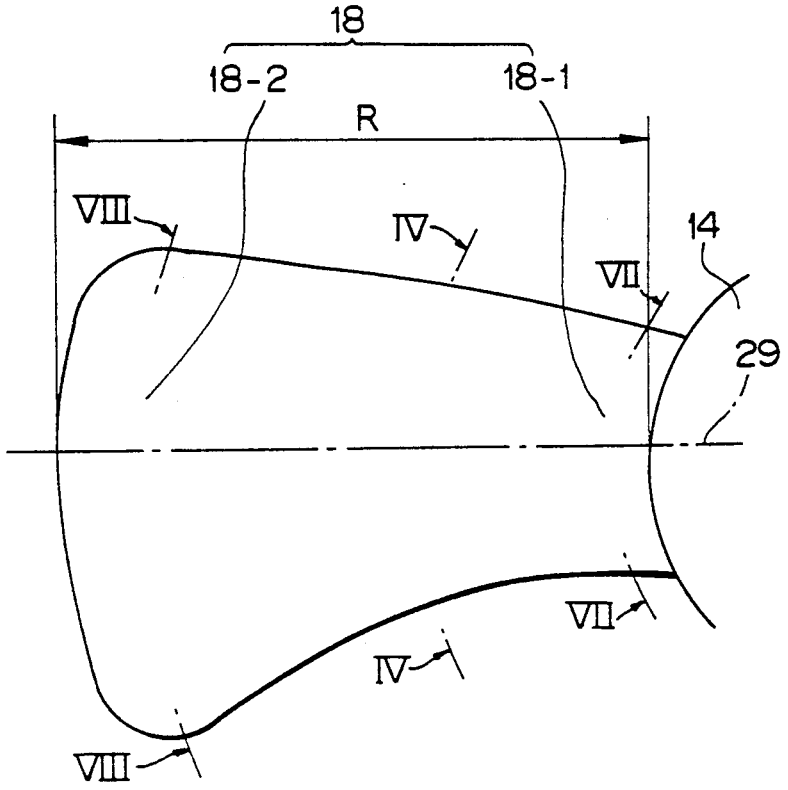
FIG. 3 shows a partial front view of a fan blade according to the present invention.
Figure 4:
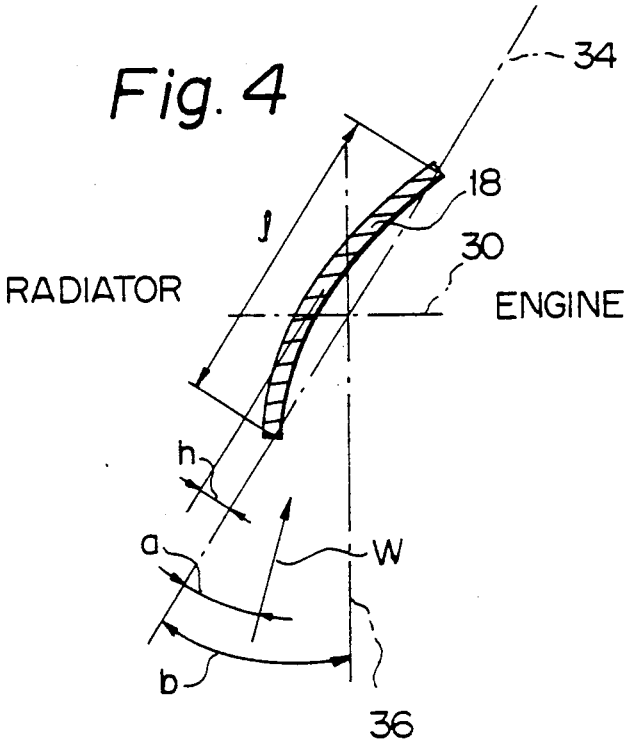
FIG. 4 shows a cross sectional view of the blade at a middle portion along a radial extension of the blade, taken along lines IV—IV in FIG. 3.
Figure 5:
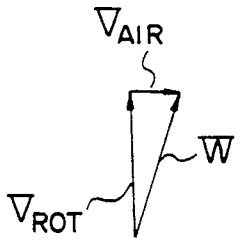
FIG. 5 illustrates a wind vector constructed by the rotation of the fan and the air flow caused by the movement of the vehicle.

FIG. 3 is a front view of the fan assembly when focused on one of the blades 18 extending radially from the boss portion 14. As shown in FIG. 3, each of the blades 18 is constructed as an elongated plate of a desired profile having an axis of a radial elongation 29, and having a root portion 18-1 having a relatively narrow width near the boss portion 14 and the free end portion 18-2 of a relatively wider width remote from the boss portion 14. As shown in FIG. 4, the blade 18 extends vertically with respect to an axis 30 for rotational movement of the boss 14 and inclined thereto. As shown in FIG. 4, the blade 18 forms an arc shape at a cross-section transverse to the axis 29 of the radial extension. The arc shaped cross section is such that it is convex on one side facing the radiator and concave on the other side facing the engine. In FIG. 4, an angle a is referred to as an angle of attack, which is an angle of the chord line 34 of the arc shape of the blade 18 to the direction of the wind W, which is, as shown in FIG. 5, a vector constructed by a flow speed component $V_{ROT}$ in the vertical line 36 generated by the rotation of the fan and an air flow speed component $V_{AIR}$ caused by the movement of the vehicle. An angle b is referred to as a mounting angle (pitch angle), which is an angle between the chord line 34 of the arc shape and the vertical line 36 transverse to the axis 30 of the rotation of the fan. In the arc shaped cross section in FIG. 4, the width of the blade, i.e., the length of the chord of the arc shape is designated by "l", and the degree of bend, i.e., the distance between the chord and the top of the arc shape is designated by "h". Furthermore, the bending ratio is defined as a ratio $\alpha$ of the bending height h to the chord length l, that is:

$$\alpha = \frac{h}{l}$$

Furthermore, a relative radial position of the blade along the axis 29 is designated by a ratio $\beta$ of a distance r to the position from the root portion to a distance R to the free end from the root portion, that is:

$$\beta = \frac{r}{R}$$

Figure 6:
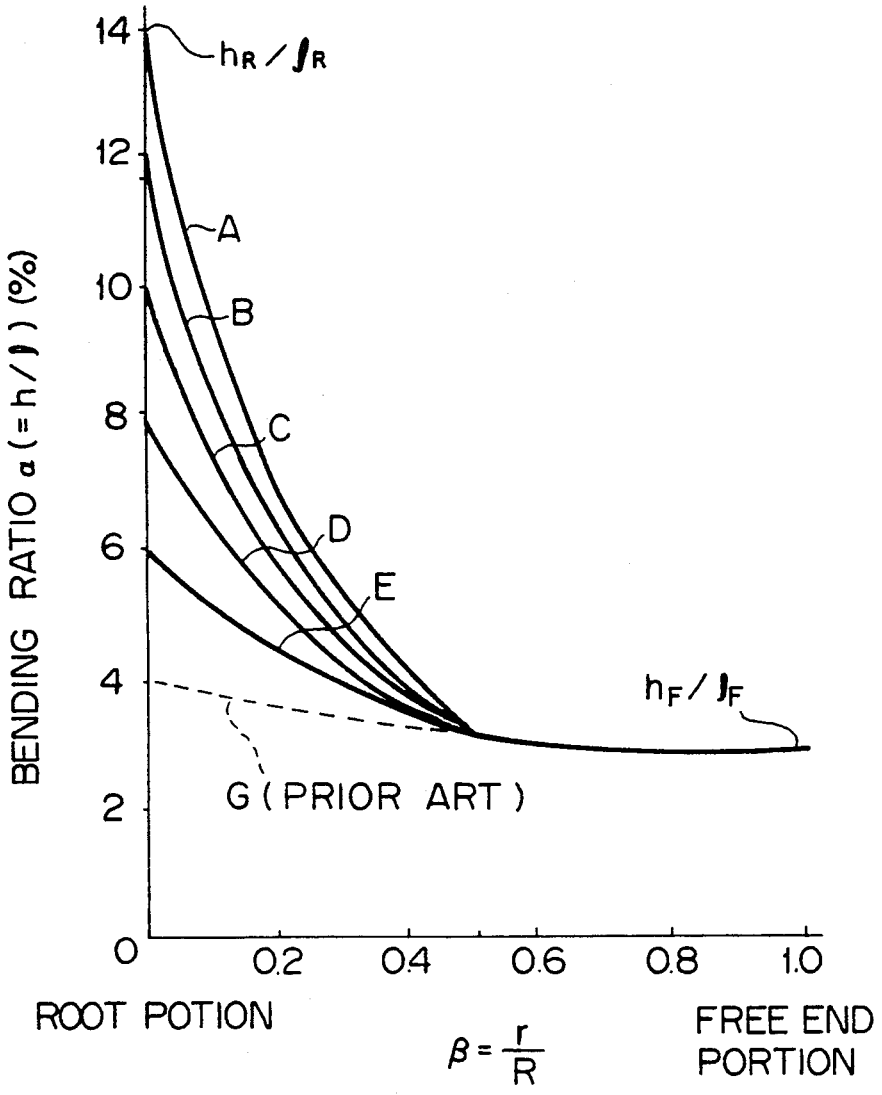
FIG. 6 shows a relationship between a relative radial position and a value of the bending ratio.

FIG. 6 shows various relationships A, B, C, D and E according the present invention between the value of the relative radial portion $\beta$ and value of the bending ratio $\alpha$. A curve G shows a similar relationship in the prior art. As will be easily seen from FIG. 6, according to the present invention, a value of the bending ratio $\alpha$ has a first section from the free end portion 18-2 ($\beta=1$) to a middle portion where an increase in the value of the bending ratio $\alpha$ is very mild, i.e., the rate of increase of the value of the bending ratio $\alpha$ is substantially unchanged, and a second section from the middle region to the root end portion 18-1 ($\beta=0$), where the increase in the value of the bending ratio $\alpha$ is sharp, i.e., the rate of increase in the bending ratio $\alpha$ increases as it approaches the root portion. Namely, from the middle portion to the root portion 18-2 ($\beta=0$), in the curve A the value of bending ratio $\alpha$ is increased to 14%, in the curve B the value of bending ration $\alpha$ is increased to 12%, in the curve C the value of bending ratio $\alpha$ is increased to 10%, in the curve D, the value of bending ratio $\alpha$ is increased to 8%, and in the curve E, the value of bending ratio $\alpha$ is 6%. Contrary to this, in the prior art as shown by the curve G, the degree of increase in the value of the bending ratio $\alpha$ is substantially constant, i.e., there is only a mild increase of the value of the bending ratio from the free end portion 18-2 ($\beta=0$) to the root portion 18-1 ($\beta=0$). Namely, the value of the bending ratio $\alpha$ at the root portion is 4%.

Figure 7:
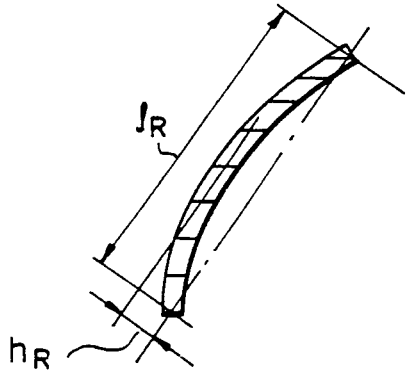
FIG. 7 shows a cross sectional view of the blade at a root portion along a radial extension of the blade, taken along lines VII—VII in FIG. 3.
Figure 8:
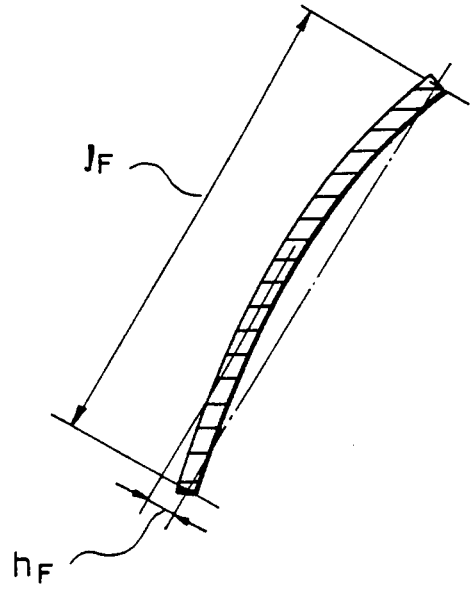
FIG. 8 shows a cross sectional view of the blade at a free end portion along a radial extension of the blade, taken substantially along lines VIII—VIII in FIG. 3.

FIG. 7 is similar to FIG. 4, but illustrates the cross sectional shape of the blade at the root portion 18-1, where the length of the chord is $l_R$, and the bending height is $h_R$, thereby providing a large bending ratio value $h_R/l_r$ because the length $l_R$ has a relatively small value, while the height $h_R$ has a relatively large value. FIG. 8 illustrates the cross sectional shape of the blade at the free end portion 18-2, where the length of the chord is $l_F$, and the bending height is $h_F$, thereby providing a small bending ratio value $h_F/l_F$ because the length $l_F$ has a relatively large value, while the height $h_F$ has a relatively small value.

Figure 9:
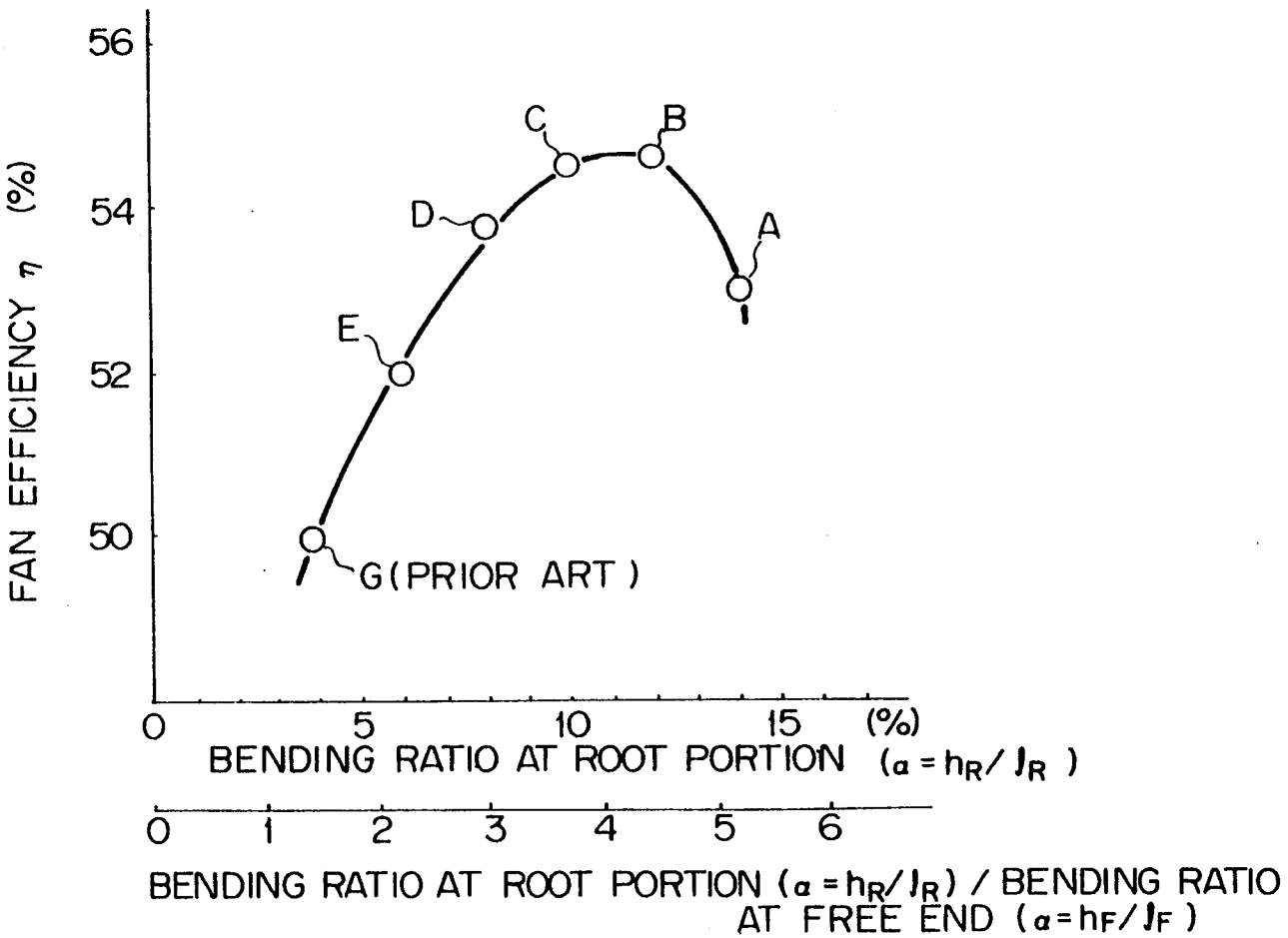
FIG. 9 shows a relationship between the bending ratio at a root portion and the fan efficiency.

FIG. 9 shows a relationship between the shapes and the values of fan efficiency. As will be easily seen, when compared with the prior art, when the value of the bending ratio $\alpha$ at the root portion ($\beta=0$) is 4%, an increased value of the fan efficiency $\eta$ can be obtained according to the present invention. Namely, between the shapes E (the value of the bending ratio $\alpha$ at the root portion ($\beta=0$) is 6%), D (the value of the bending ratio $\alpha$ at the root portion ($\beta=0$) is 8%), C (the value of the bending ratio $\alpha$ at the root portion ($\beta=0$) is 10%) and B (the value of the bending ratio $\alpha$ at the root portion ($\beta=0$) is 12%), the higher the value of the bending ratio $\alpha$ at the root portion ($\beta=0$), the higher the value of the fan efficiency $\eta$.

However, as will also be clear from FIG. 9, when the value of the bending ratio $\alpha$ at the root portion ($\beta=0$) exceeds 12% as in the case of the example A (the value of the bending ratio $\alpha$ at the root portion ($\beta=0$) is 14%), the value or the fan efficiency $\eta$ begins to drop. Such a drop in the fan efficiency in the region of a large value bending ratio $\alpha$ is caused by the fact that the flows generated by the rotation of the fan blade are apt to be separated from a vacuum pressure generating surface of the blade, thereby reducing the ratio $\epsilon$ between a drag force factor $C_D$ and a lift force factor $C_L$. Namely, in FIG. 10, a curve m is a relationship between the bending ratio $\beta$ and a ratio $\epsilon$ of the drag to the lift force. As will be easily seen from FIG. 6, a value of the bending ratio $\beta$ larger than 12% causes the ratio $\epsilon$ to rapidly increase, which reduces the blade efficiency significantly. Thus, it is clear from the above that the value of the bending ratio $\alpha$ at the root portion ($\beta=0$) is 12%, which is more than four times the value (2.7%) of the bending ratio $\alpha$ at the root portion in the prior art.

Figure 10:
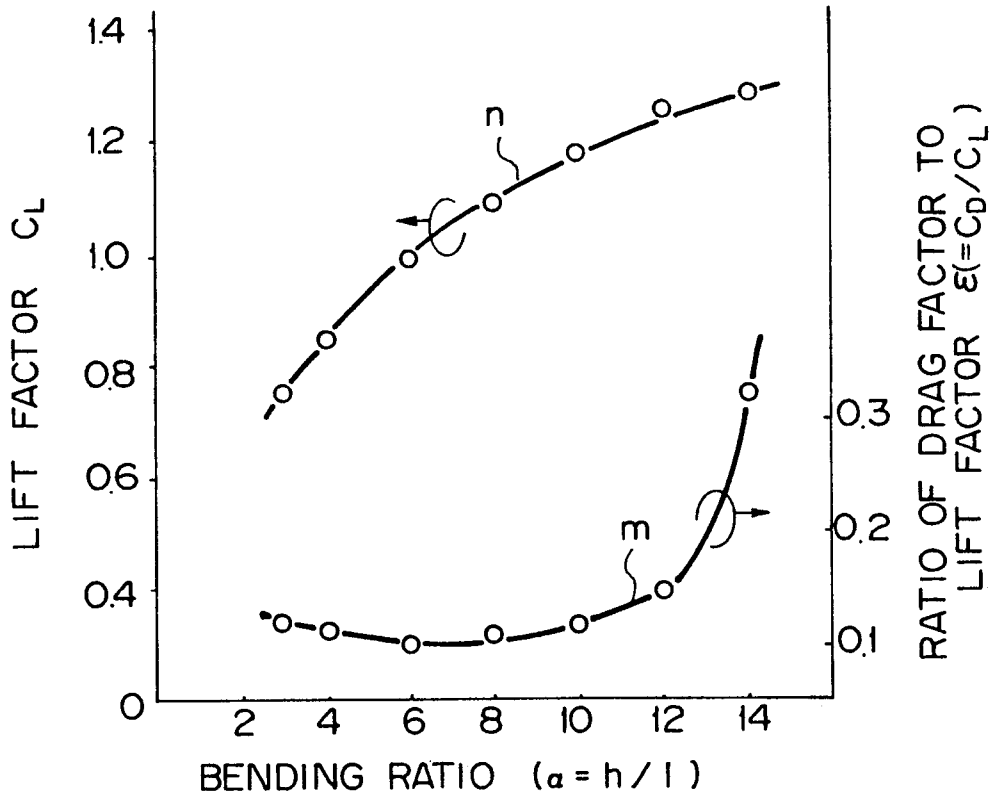
FIG. 10 shows relationships between the bending ratio and the lift factor, and between the bending ratio and a ratio of the drag factor to the lift factor.

In FIG. 10, a curve n is a relationship between the bending ratio $\beta$ and the lift factor $C_L$. The relationships n and m in FIG. 6 are determined when an angle of attack a is 10°.

As will be clear from the above, the division of the blade 18 into the first section from the free end portion to the middle portion of a substantially non increasing bending ratio value $\alpha$ value and a second section from the middle portion to the root portion 18-1 of a sharply increasing bending ratio value $\alpha$ can effectively use the total area of the blade 18, and can reduce the stagnant area of low air speed otherwise generated at the area near the root portion 18-1.

Furthermore, it should be noted that a small bending ratio value $\alpha$ from the middle portion to the free end portion according to the present invention is preferable for obtaining desired flow conditions. Namely, the middle portion of the blade is spaced from both the boss portion 14 and the shroud 20, which may reduce the speed of the air flow which allows the required flow condition to be obtained irrespective of a relatively small total pressure at the middle portion of the blade owing to a low peripheral speed of the blade at this portion. At the free end portion of the blade, the peripheral speed of the blade is high, thereby increasing the total pressure, which is effective for obtaining desired flow conditions for the air passing the blade.

Figure 11:
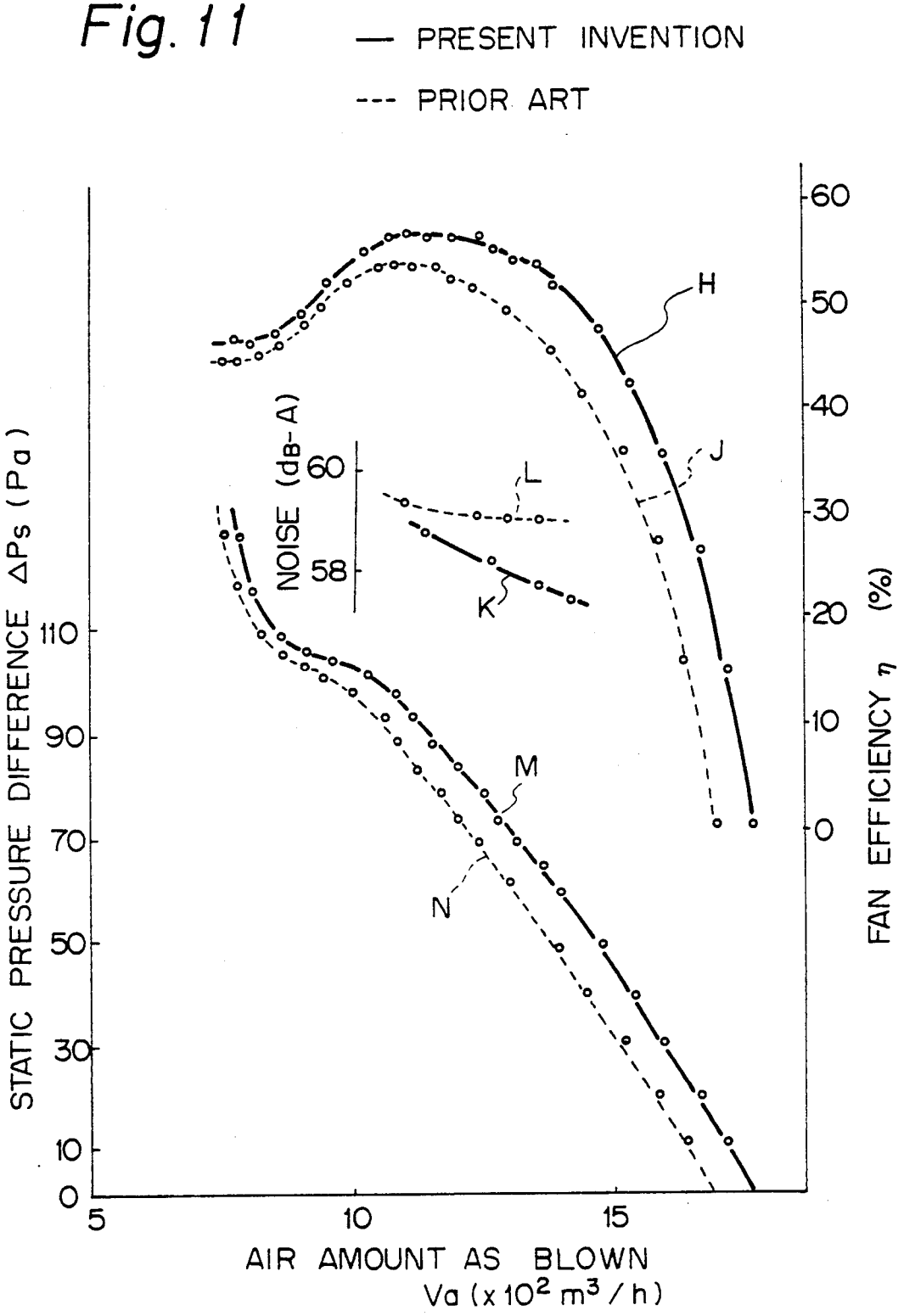
FIG. 11 shows relationships between the air blown amount and the fan efficiency, between the air blown amount and the static pressure difference, and between the air amount and noise in a comparison between the prior art and the present invention.

In FIG. 11, curves H and J are relationships between the flow amount of the air Va ($\times 10^2$ $m^3/h$) and the fan efficiency $\eta$(%). The curve H corresponds to the present invention when the value of the maximum bending ratio $\alpha$ at the root portion is 12%, while the curve J corresponds to a prior art when the value of the bending ratio at the root portion is 4%, and is substantially unchanged throughout the entire portion of the blade. As to relationships between the flow amount of the air Va and the noise level (dB-A), curve K corresponds to the present invention, and L corresponds to the prior art. Finally, as to relationships between the flow amount of the air Va and the static pressure difference $\Delta P$ curve M corresponds to the present invention, and curve N corresponds to the prior art. As is easily understood, as shown in FIG. 11, increased fan efficiency $\eta$ and reduced noise can be obtained along a wider range of blowing.

According to the embodiment, the bending ratio at the root portion is selected at 12%. However, a selected value of the bending ratio within a range between 8 to 12% can be employed so as to increase fan efficiency and reduce operating noise. It is also preferable that a value of the bending ratio at the root portion to the value of the bending ratio at the free end portion be in a range between 3 to 5.

In the embodiment as illustrated, a rapid increase in the bending ratio is continued from the middle portion up to the free end portion of the blade. However, a rapid increase in the bending ratio from the middle portion can be terminated at a point before the root portion is reached, and this maximum bending ratio value is maintained up to the root end portion.

The present invention is not limited to the particular type of blade shown in the drawings. Namely, the concept of the present invention can be utilized for many types of blades, including such blades as a forward advancing blade inclined in one rotational direction, a rearward advancing blade inclined in the opposite direction, a forwardly inclined blade inclined in the direction of the inflow of air, and a rearwardly inclined blade inclined in the reverse direction. Furthermore, the concept of the present invention can also be employed for a fan with rings at its outer periphery.

We claim:

1. A fan device adapted so as to be connected to a source of rotational movement that imparts rotational movement to the fan device, said fan device comprising:

a boss having an axis of rotation and a circumferential wall about said axis, the boss adapted for connection to the source of rotational movement so that the fan device rotates about the axis; and a plurality of radially extending, circumferentially spaced blades connected to said circumferential wall of said boss, each blade having a root portion connected to the boss and a free end portion, each of said blades having an arc shaped cross section transverse to a radial extension of said blade, in a predetermined bending ratio of height of the arc to length of a chord of the arc;

the blade being divided into, along said radial extension, a first region away from the boss and a second region proximate the boss, the arc shape of the cross section being such that the value of said bending ratio at the first region increases from the free end portion at a substantially constant changing rate, and at the second region increases toward the root portion at a variable changing rate that is larger than the constant rate and increases as the arc shape of the cross section approaches said root portion.

2. A fan device according to claim 1, wherein the value of the bending ratio at the root portion is in a range between 6% to 14%.

3. A fan device according to claim 2, wherein the value of the bending ratio at the root portion is in a range between 8% and 12% and the value of the bending ratio in the first region is below 4%.

4. A fan device according to claim 1, wherein a value of the bending ratio at the root portion is three to five times larger than the bending ratio at the free end portion.

5. A fan device according to claim 1, wherein the first and second regions are connected to each other at a portion of the blade that is substantially located at the center along the radial extension of the blade.

6. A fan device according to claim 1, wherein the variable changing rate of the bending ratio increases toward the root portion from a middle portion of the blade.

7. A fan device according to claim 1, wherein said fan device is substantially made of a plastic resin material.

8. A cooling system for an automobile having an engine room for housing a body of an internal combustion engine, said engine room having an inlet for the introduction of an outside air flow, said system comprising:

at least one heat exchanger disposed between said inlet and the engine body;

a fan device disposed between the engine body and the heat exchanger;

means for imparting rotational movement to said fan device to create an air flow in a direction from the heat exchanger to the engine body, and;

a tubular shroud disposed around the fan device, the shroud having a first end extending to the heat exchanger and a second end extending to the fan device;

said fan device comprising:

a boss having an axis of rotation and a circumferential wall about said axis, the boss being connected to the imparting means so that the fan device rotates about the axis and;

a plurality of radially extending, circumferentially spaced blades connected to said circumferential wall of said boss, each blade having a root portion connected to the boss and a free end portion adjacent to said shroud, each of said blades having an arc shaped cross section transverse to a radial extension of said blade, said arc having a predetermined bending ratio of height of the arc to length of a chord of the arc;

the blade being divided into, along said radial extension, a first region including said free end portion proximate the shroud and a second region including said root portion near the boss; the arc shape of the cross section being such that the value of said bending ratio increases from the free end portion at a substantially constant rate, and at the second region increases toward the root portion at a varying rate that is larger than the substantially constant rate and increases as the arc shaped cross-section approaches said root portion.

9. A system according to claim 8, wherein the value of the bending ratio in the first portion is below 4% and the value of the bending ratio at the root portion is between 8% and 12%; and wherein a ratio of the bending portion at the root portion to the bending ratio at the free end portion is between 3 and 5.

* * * * *